United States Patent [19]

Shores et al.

[11] Patent Number: 4,506,240

[45] Date of Patent: Mar. 19, 1985

[54] MAGNET ASSEMBLY FOR A YIG TUNED FILTER HAVING ADJUSTMENT MEANS TO ELASTICALLY STRAIN A POLE PIECE

[75] Inventors: David H. Shores, Lake Oswego; Mark Whiting, Beaverton, both of Oreg.

[73] Assignee: Tektronix, Inc., Beaverton, Oreg.

[21] Appl. No.: 413,948

[22] Filed: Sep. 1, 1982

[51] Int. Cl.[3] ..... H01P 1/218

[52] U.S. Cl. ..... 333/202; 335/298; 333/219

[58] Field of Search ..... 335/298, 297, 296, 212; 336/218, 134; 333/202, 206, 219

[56] References Cited

U.S. PATENT DOCUMENTS

| | | | |
|---|---|---|---|
| 3,544,918 | 12/1970 | Venator, Jr. | 331/107 DP |
| 3,781,735 | 12/1973 | Haas | 335/297 X |
| 3,898,599 | 8/1975 | Reid et al. | 335/296 X |
| 3,973,204 | 8/1976 | Keiter | 333/206 X |
| 4,093,912 | 6/1978 | Double et al. | 335/298 X |
| 4,468,643 | 8/1984 | Barger | 333/202 |

FOREIGN PATENT DOCUMENTS

| | | |
|---|---|---|
| 1047221 | 11/1966 | United Kingdom . |
| 1147449 | 4/1969 | United Kingdom . |

*Primary Examiner*—Eugene R. LaRoche
*Assistant Examiner*—Benny Lee
*Attorney, Agent, or Firm*—John Smith-Hill

[57] ABSTRACT

A magnet assembly comprises two pole pieces mounted so that their respective pole faces are in generally parallel spaced relationship. A mechanism applies force to one of the pole pieces at a location adjacent the pole face thereof and in direction transverse to the distance between the pole faces, whereby the pole piece that is acted upon is elastically strained and the relative orientation of the pole faces is altered accordingly.

5 Claims, 4 Drawing Figures

MAGNET ASSEMBLY FOR A YIG TUNED FILTER HAVING ADJUSTMENT MEANS TO ELASTICALLY STRAIN A POLE PIECE

This invention relates to magnet assemblies, and in particular to a mechanism for making fine adjustments in the relative orientation of the pole faces of a magnet assembly.

BACKGROUND OF THE INVENTION

YIG (yttrium iron garnet) tuned filters are used in spectrum analyzers. The YIG tuned filter comprises at least one YIG ellipsoid, generally a sphere, disposed in the gap between generally parallel pole faces at the ends of the two magnet posts of an electromagnet. The resonant frequency of a YIG sphere is proportional to the strength of the magnetic field in which the sphere is placed, which is in turn dependent on the distance between the pole faces at the sphere location. Because of the anisotropic properties of YIG material, the resonant frequency is also dependent upon the angular position of the sphere about its axis. Each YIG sphere in a YIG tuned filter comprising more than one YIG sphere must have the same resonant frequency if the filter is to function properly. If the pole faces of the magnet are not parallel within about 2 nm, the spheres are subjected to sufficiently different field strengths that their resonant frequencies will be different if they have the same angular position. The resonant frequencies can then be made equal by rotating one or both spheres, but if the energizing current for the magnet coil is changed in order to change the magnetic field in the gap and hence the resonant frequency of the YIG spheres, the resonant frequencies of the two YIG spheres will no longer be the same.

One way to ensure that the resonant frequencies of the YIG spheres remain equal when the magnet coil's energizing current is changed is to grind the magnet posts so that the pole faces are parallel to within about 2 nm. However, this presents severe difficulties, especially when the electromagnet is assembled from separate pieces instead of being machined from a single block. When the electromagnet is assembled from separate pieces, the desired parallelism may be obtained by inserting a metal shim in the mounting structure for the pole pieces.

SUMMARY OF THE INVENTION

According to the present invention there is provided a magnet assembly comprising first and second pole pieces having respective pole faces and first and second members rigidly connected to the first and second pole pieces, respectively, and so mounting the pole pieces with respect to each other that the pole faces are in generally parallel confronting relationship and define a pole gap therebetween. At least the first pole piece has a support region which is spaced from the pole gap and by which the first pole piece is connected to the first member. The assembly further comprises a mechanism for supplying a force to the first pole piece at a location adjacent the pole face thereof and in a direction transverse to the distance between the pole pieces, whereby the first pole piece can be elastically strained about the support region and the relative orientation of the pole faces is altered accordingly.

The present invention may be used in a YIG tuned filter to establish accurate parallelism between the pole faces. In a YIG tuned filter embodying the invention, the pole faces can be initially set parallel to within about 150 nm without difficulty. The pole faces can be brought into parallel relationship (within about 2 nm) by deflecting the end of a magnet post by a maximum distance of about 12.5 μm, which is well below the strain which would put a permanent set in the metal. Therefore, a continuous and reversible adjustment is obtained.

For a better understanding of the invention, and to show how the same may be carried into effect, reference will now be made, by way of example, to the accompanying drawings in which:

DETAILED DESCRIPTION OF THE DRAWINGS

Figure 1:
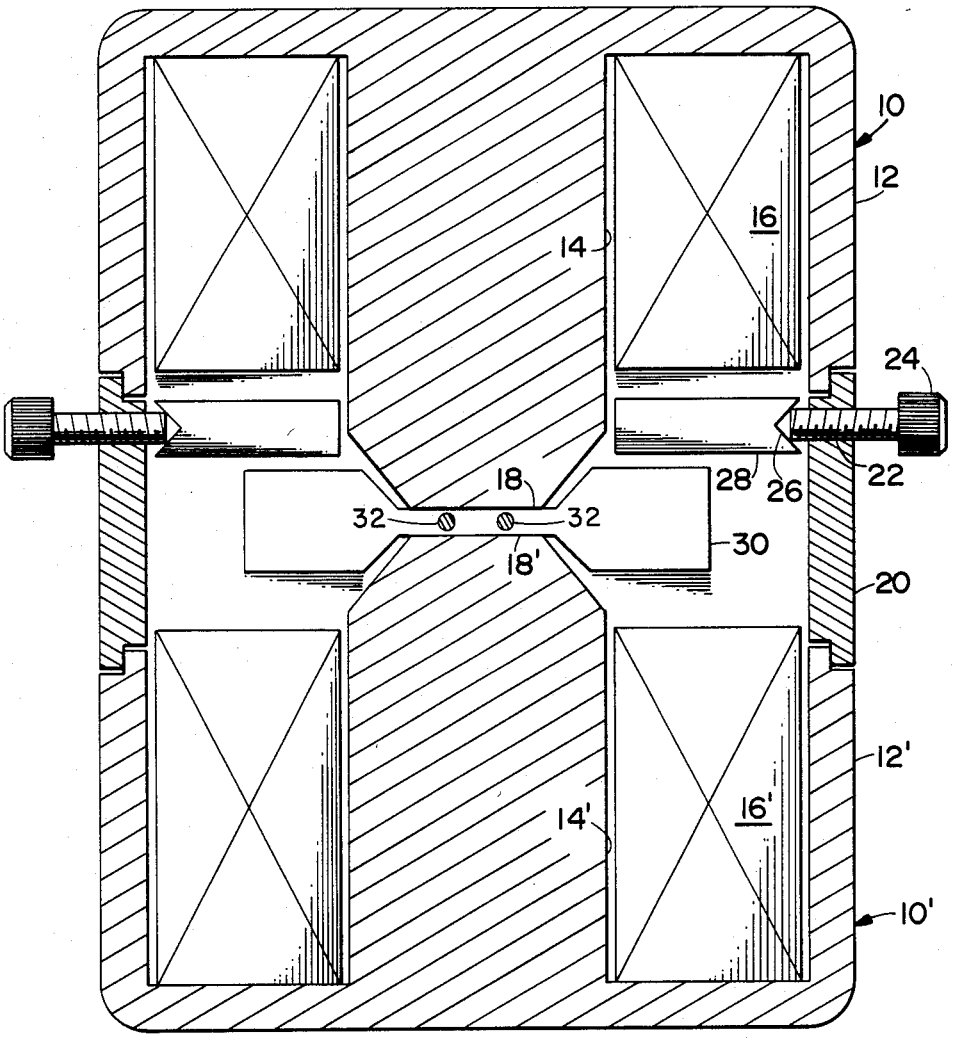
FIG. 1 is a longitudinal sectional view through a YIG tuned filter incorporating a magnet assembly embodying the present invention.

The illustrated YIG tuned filter comprises two cups 10, 10′ of ferromagnetic material, such as the high permeability magnetic alloy known as Carpenter 49, each having an annular wall 12, 12′ and formed with a central magnet pole piece or post 14, 14′. Each cup is provided with an electromagnet coil 16, 16′ disposed in the annular space defined between the post and the interior surface of the wall of the cup. Each post 14, 14′ has a proximal end, whereby it is mounted in cantilever fashion to the base of the cup, and a distal end which is conically tapered and projects beyond the rim of the cup, terminating in a pole face 18, 18′. The pole faces are maintained in spaced relation by a spacer ring 20 which is disposed between the rims of the cups 10, 10′. The cups 10, 10′ and the spacer ring 20 are clamped together between end plates (not shown) by means of screws (not shown) acting upon the end plates. The pole faces 18, 18′ are generally parallel. Disposed partially between the pole faces is a housing 30 containing YIG spheres 32 and the coupling loops of the filter. The housing may be of the type described in U.S. Pat. No. 4,344,201 issued June 8, 1982. The YIG spheres themselves are positioned between the pole faces 18, 18′.

The spacer ring 20 is formed with radial bores 22 which are internally threaded and in which respective adjustment screws 24 are fitted. The screws extend beyond the interior surface of the spacer ring 20, into a V-shaped groove 26 which is formed in the periphery of a tracking ring 28. The tracking ring surrounds the magnet post 14 adjacent the distal end thereof. Thus, the screws can be used to press the tracking ring 28 against the magnet post 14 and deflect its distal end, thereby altering the relative orientation of the pole faces 18, 18′.

In order for the YIG spheres to have the same resonant frequency when they have the same orientation, it is necessary that the spheres be subjected to the same magnetic field strength. Accordingly, as a practical matter the field strengths between the pole faces 18, 18′ must be uniform, and this in turn requires that the pole faces be parallel to within about 2 nm. However, since the magnet gap is established by three distinct elements, namely the cups 10, 10′ and the spacer ring 20, it is not possible as a practical matter to assemble the magnet with the pole faces parallel to within less than about 150 nm. Each magnet post is about 2.5 cm. long, and accordingly it is only necessary to displace the distal end of the post 14 by about 12.5 μm in order to achieve acceptable parallelism between the magnet faces. The magnet posts are about 1.25 cm. thick, and therefore the displacement of the distal end of the magnet post 14 is well below the strain which would put a permanent set in the metal. Thus, the adjustment that is obtainable using the tracking ring 28 and the adjustment screws 24 is continuous and reversible.

Figure 2A:
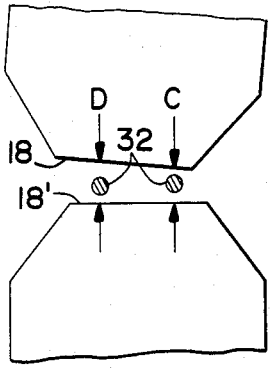
FIGS. 2*a* and 2*b* illustrate how adjustment of the pole faces of the magnet assembly is effected.
Figure 2B:
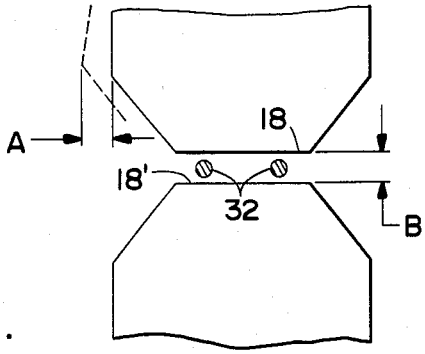

The effect of displacement of the magnet post 14 is shown in FIG. 2. FIG. 2*a* illustrates the pole faces 18, 18' and the YIG spheres 32 prior to displacement of the magnet post 14. The dimension D shown in FIG. 2*a* differs from dimension C by up to 150 nm. By displacing the end of the post 14 through a maximum distance A about 12.5 μm, the relative orientation of the pole faces 18, 18' is changed so that the pole gap has a width B that is uniform within about 2 nm, as shown in FIG. 2*b*.

Figure 3:
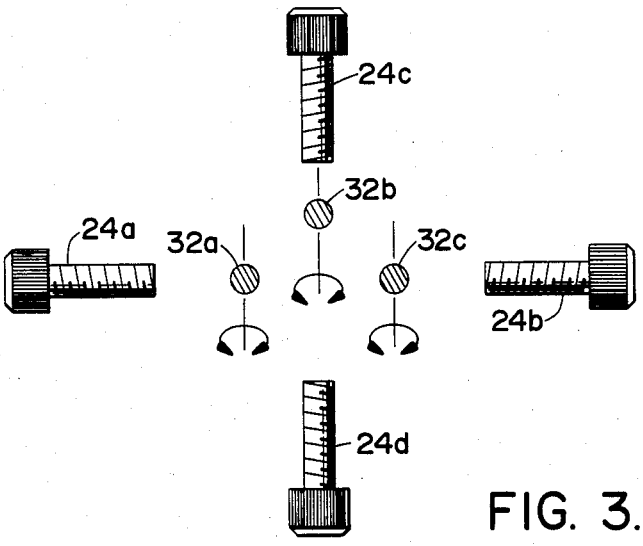
FIG. 3 illustrates the procedure for adjusting the pole faces.

The number of screws that are employed depends on the number of YIG spheres in the filter, because it is necessary to be able to effect displacement of the magnet post 14 along the line(s) joining the centers of the spheres. If there are only two spheres, as in U.S. Pat. No. 4,344,201, there is only one such line and accordingly only two diametrically opposed screws are needed in order to effect displacement in both directions along the line. If there are three or more spheres, at least three screws are needed. If three screws are used, and they are positioned equiangularly about the spacer ring 20, they will be able to bring about displacement of the post 14 in any direction perpendicular to the central axis of the spacer ring. However, it is preferred that four screws be used even in the case where only three spheres are employed. The procedure for adjusting the screws in such a case will now be described with reference to FIG. 3.

1. Adjust the current through the coils 16, 16' to the value associated with the low end of the filter's range of resonant frequencies (about 1.7 GHz.).

2. Rotate the input YIG sphere 32*a* about an axis in a plane perpendicular to the central axis of the spacer ring to a position in which its resonant frequency is independent of temperature.

3. Rotate the output YIG sphere 32*c* about an axis in a plane perpendicular to the central axis of the spacer ring to a position in which its resonant frequency is the same as that of the input YIG sphere 32*a*.

4. Increase the coil current to the value associated with the high end of the filter's range of resonant frequencies (about 21 GHz).

5. Measure the difference between the resonant frequencies of the input and output YIG spheres, and adjust the screws 24*a* and 24*b* to eliminate the difference.

6. Repeat step 1.

7. Repeat step 3, but rotate the interstage YIG sphere 32*b* instead of the output YIG sphere 32*c*.

8. Repeat step 4.

9. Measure the difference between the resonant frequencies of the input and interstage YIG spheres, and adjust the screws 24*c* and 24*d* to eliminate the difference.

It will be appreciated that the invention is not restricted to the particular magnet assembly that has been described and illustrated, since it will be apparent that variations may be made therein without departing from the scope of the invention as defined in the appended claims, and equivalents thereof. For example, the tracking ring 28 may be formed with blind bores for receiving the screws 24, instead of the V-shaped peripheral groove.

We claim:

1. A magnet assembly comprising first and second pole pieces having respective pole faces, first and second members rigidly connected to the first and second pole pieces respectively and so mounting the pole pieces with respect to each other that the pole faces are in generally parallel confronting relationship and define a pole gap therebetween, at least said first pole piece being resilient and having a support region which is spaced from said pole gap and by which said first pole piece is connected to said first member, and the assembly further comprising a mechanism for applying a force to said first pole piece at a location adjacent the pole face thereof and in a direction transverse to the distance between the pole pieces, whereby said first pole piece can be elastically strained about said support region in a direction transverse to said distance and the relative orientation of said pole faces is altered accordingly.

2. A magnet assembly according to claim 1, wherein the first and second members are cup-shaped, and wherein the magnet pole pieces are in the form of respective magnet posts which project axially from the bases of the respective cup-shaped members, internally thereof, and the assembly further comprises a spacer ring which is engaged at opposite ends respectively by the rims of the cup-shaped members, and said mechanism comprises a tracking ring which surrounds said first pole piece and a plurality of screws which are in threaded engagement with the spacer ring and engage the tracking ring.

3. A magnet assembly according to claim 2, further comprising a magnet coil surrounding at least one of the magnet posts and disposed in the annular gap between the exterior of said one magnet post and the interior of the respective cup.

4. A ferrimagnetic resonator, comprising a magnet assembly according to claim 1, and at least two ferrimagnetic resonance elements disposed in said pole gap.

5. A magnet assembly according to claim 2, wherein the magnet posts are constructed monolithically with the respective cup-shaped members.

* * * * *